United States Patent [19]

Gartzke

[11] Patent Number: 4,666,230

[45] Date of Patent: May 19, 1987

[54] COAXIAL CABLE CONNECTOR ASSEMBLY

[75] Inventor: Donald G. Gartzke, Hamilton, Mass.

[73] Assignee: Microwave Systems & Technology, Inc., Billerica, Mass.

[21] Appl. No.: 686,932

[22] Filed: Dec. 27, 1984

[51] Int. Cl.[4] ..... H01R 17/18

[52] U.S. Cl. ..... 339/177 R; 339/275 R

[58] Field of Search ..... 339/275 R, 177, 94 R, 339/94 M, 218

[56] References Cited

U.S. PATENT DOCUMENTS

| | | | |
|---|---|---|---|
| 2,802,924 | 8/1957 | Hebenstreiet | 339/177 R |
| 3,465,281 | 9/1969 | Florer | 339/177 R |
| 3,708,781 | 1/1973 | Grompeter | 339/177 R |
| 3,970,352 | 7/1976 | Dorrell et al. | 339/94 M |
| 4,280,749 | 7/1981 | Hemmer | 339/177 R |
| 4,445,745 | 5/1984 | Cartesse | 339/177 R |
| 4,545,637 | 10/1985 | Bosshard et al. | 339/275 R |

FOREIGN PATENT DOCUMENTS

| | | | |
|---|---|---|---|
| 2424644 | 12/1979 | France | 339/177 E |

*Primary Examiner*—Gil Weidenfeld
*Assistant Examiner*—David L. Pirlot
*Attorney, Agent, or Firm*—Robert T. Dunn

[57] ABSTRACT

A Super High Frequency (SHF) cable and connector assembly for connection to a relatively low impedance circuit, such as a YIG filter for which the connection impedance is on the order of ten ohms, includes: a SHF coaxial cable having a metal ferrule soldered to the outer conductor at one end thereof providing a substantially larger diameter outer conductor at that end than the outer conductor of the cable; and a coaxial plug connector having a coaxial recess in the housing thereof at one end to accommodate the cable ferrule and into which the ferrule is force-fit to make an intimate metal to metal contact therewith, while the cable center conductor engages the connector center conductor within the recess; the connector having within a space that is common to the connector housing, dielectric and center conductor and is filled with a suitable dielectric epoxy while the housing and center conductor are in proper alignment so that when the epoxy sets, it captivates the center conductor maintaining it in alignment with the housing and the housing recess and so it will receive the cable center conductor that extends inside the ferrule when the ferrule is force-fit into the housing recess. After force-fitting the ferrule to the connector, the interface between the outer diameter of the ferrule and the housing recess is sealed with epoxy, thereby sealing the electrical connections of the cable and connector within the connector.

8 Claims, 9 Drawing Figures

COAXIAL CABLE CONNECTOR ASSEMBLY

BACKGROUND OF THE INVENTION

This invention relates to coaxial connectors for connection to coaxial cable plugs and more particularly to a coaxial cable-connector assembly for connection to a Super High Frequency (SHF) electrical circuit element for conducting SHF signals to or from the element and to which a conventional coaxial cable plug can connect.

Heretofore, a coaxial cable-connector assembly for direct connection of the cable part thereof to a high frequency circuit element operating in the SHF range of 18 to 20 GHz and higher has been provided to users in the form of a coaxial cable four to six inches long with a coaxial connector at each end. Each connector is adapted for threadably engaging the plug of a conventional coaxial cable. The user makes two cable-connector assemblies of this by cutting the cable at a suitable point between the two connectors. Each of these assemblies is used by first removing the outer conductor and dielectric a ways back from the cut end to expose the center conductor which the user then attaches to the high frequency circuit element, thereby providing a coaxial port for that connection to which the plug of a conventional coaxial cable can be connected. Thus, the product provides the user with two SHF coaxial ports to the circuit.

At SHF frequencies of 18 to 20 GHz, or higher, the cable of the assembly is as small as Number 047, 50 ohm cable (0.047 inches in diameter) and the threads of the connector attached to the cable are ¼ inch by 36 threads per inch and so the connector is also quite small. Clearly, connecting such a small cable and connector requires the engagement of the very fine, wire-like (about 0.010 inches in diameter), center conductor of the cable with the center conductor of the connector so that the two fit together in intimate electrical and mechanical contact, poses some problems in fabrication. One of the problems is to align the connector center conductor with the connector outer conductor housing so that they are in perfect coaxial alignment, so when the connector receives the inserted end of the cable that is attached thereto, the fine, wire-like center conductor of the cable slides inside the connector center conductor. Any slight shift in the position of the connector center conductor relative to the connector housing may upset this alignment.

For example, such a coaxial cable-connector assembly is used to provide a very low impedance electrical connection to SHF circuit elements such as a YIG filter. These assemblies are sometimes called "YIG cable assemblies". They provide a connection to the YIG filter for a conventional coaxial cable plug external of the YIG circuit. As mentioned above, the cable assembly is usually provided with a length of cable four to six inches long and a connector attached to each end. The user cuts the cable to the length desired and uses each half to make a connection for a conventional coaxial cable plug. Each is used by baring the fine, wire-like center conductor a sufficient length for attachment to the YIG filter.

In the past, such a cable assembly has been made by inserting a bared end of the cable with the wire-like center conductor thereof projecting, into an accommodating end of the connector so that the center conductor of the cable (hopefully) fits inside a spring finger at that end of the connector center conductor. Then, the outer conductor of the cable is soldered to the connector housing. Following that, epoxy is applied around the connector center conductor, dielectric and housing through a hole provided therein to fix them in position and so insure that radial and axial alignments of the connector center conductor, dielectric and housing are maintained during use. This technique is sometimes referred to as "epoxy captivated contacts".

At the assembly of the cable and connector, the bared end of the cable that is inserted into an accommodating part of the connector, is inserted before the captivating epoxy is applied around the connector parts to fix their positions, and then the cable is soldered to the connector. The captivating epoxy cannot be applied before inserting the cable and soldering, because the heat of soldering would so effect the epoxy that it would not be effective to fix the parts in position. At this assembly, when the bared cable is inserted into the connector accommodation, any misalignment of the connector spring finger and cable center conductor will at least force either or both out of position with respect to the outer conductors and so will likely impair electrical performance, or, at worse, bend the very thin cable center conductor so that it either does not contact the connector center conductor spring finger or it shorts to the connector housing. As a consequence, fabrication of such cable-connector assemblies suffers a high rejection rate.

SUMMARY OF THE INVENTION

It is an object of the present invention to provide a method and means of construction of an improved coaxial cable-connector assembly for connection to a circuit element of a SHF circuit and in which the assembly of the cable to the connector is accomplished while the connector parts are fixed in position before the cable is inserted into the connector for attachment thereto.

It is another object of the present invention to provide a coaxial cable-connector assembly of such construction that the connector center conductor, dielectric and housing can be fixed in position by captivating epoxy before the cable is inserted into the connector for assembly therewith.

It is another object to provide a coaxial cable-connector assembly for a low impedance coaxial connection to a SHF circuit element wherein, the assembly of the cable and connector is accomplished and completed without requiring the application of heat thereto such as in a soldering step.

It is another object to provide a coaxial cable-connector assembly for connection to a low impedance circuit element of a SHF circuit wherein, at the assembly of the cable and connector the cable is secured fast to the connector by a force-fit of the cable thereto and the force-fit is sealed so that electrical connections made between the cable and connector conductors are sealed within the connector.

In accordance with the present invention, a SHF coaxial cable-connection assembly for connection to a low impedance element of a SHF circuit to provide a coaxial cable port for the element includes: a coaxial cable of impedance on the same order as the element impedence with a conductive ferrule attached to an end of the cable to the outer conductor thereof, the outside diameter of the ferrule providing a smooth electrically conductive cylindrical surface; and a coaxial conductor of impedance on the same order as the cable and having a coaxial recess at one end to accommodate a forced fit therein with the outer diameter of the ferrule. At assembly, the ferrule is force-fit into the connector recess while the cable wire-like center conductor that projects from the end of the cable and is enclosed by the ferrule engages an accommodating connector center conductor spring finger and slides inside the finger, making mechanical and electrical connection therewith. The fit between the ferrule and the connector recess is sealed with an epoxy applied to the outside of the connector, sealing the points of connection of the cable and connector conductors inside the connector.

Construction of this assembly according the method of the present invention requires that the connector be equipped with an opening through the housing to a space through the dielectric and surrounding a portion of the center conductor so that epoxy can be inserted therein while the housing and center conductor are held in fixed concentric alignment, so that when the epoxy hardens the alignment is maintained. Thus, the connector contacts are "epoxy captivated". Following that step, the ferrule soldered to the end of the cable is inserted into the coaxial recess and there is assurance that the center conductor of the cable within the ferrule will precisely meet the connector center conductor spring finger. This alignment must be near perfect and must be maintained as the ferrule is force-fit into the recess in the connector housing.

In accordance with a preferred embodiment of the present invention, the end of the cable to which the ferrule is attached is first prepared by cutting back the outer conductor and dielectric of the cable so that the wire-like center conductor thereof extends a predetermined distance beyond the end. Then, the ferrule is slipped over the outer conductor at that end so that the ferrule extends beyond the end and encloses the projecting portion of the center conductor. Next, the ferrule is soldered to the outer conductor of the cable. Meanwhile, the connector is prepared by aligning the center conductor and housing thereof into precise coaxial and axial alignment, injecting the captivating epoxy into the housing so that it flows around the dielectric and center conductor and while the center conductor and housing are so held in alignment, allowing the epoxy to harden, thereby fixing the connector center conductor spring finger in precise coaxial alignment and concentric with the housing recess at the end thereof to which the cable is to be attached. Then, the ferrule with cable attached is forced into the recess until it bottoms at a shoulder of the housing at the bottom of the recess without contacting the connector dielectric at the bottom of the recess, as such contact might upset the fixed position of the dielectric in the housing secured by the set captivating epoxy.

At this assembly, the connector center conductor spring finger of is in proper alignment with the recess and the center conductor of the cable is in proper alignment with the ferrule, and so the two center conductors are in proper alignment with each other as the ferrule is forced into the recess and they engage, the cable center conductor being forced into the connector center conductor making intimate mechanical and electrical contact therewith.

An annular recess set back from the inserted end of the ferrule and a counter recess at the entrance to the connector housing recess are provided so that when the ferrule is fit into the connector housing recess as described, an annular space is defined at the recess entrance to accept epoxy that seals the fit of the ferrule to the connector and so the electrical connections between the two are sealed within the connector by this epoxy. This annular space that accepts the sealing epoxy may include an undercut portion into which the epoxy flows so that when this epoxy ring sets, the ferrule cannot be pulled from the connector housing without shearing off part of the sealing epoxy ring from another part. Thus, the epoxy not only seals the electrical connections within the connector, but also mechanically secures the ferrule to the connector.

These and other objects and features of the present invention are apparent from the accompanying drawings and description.

DESCRIPTION OF EMBODIMENTS OF THE INVENTION

Figure 2:
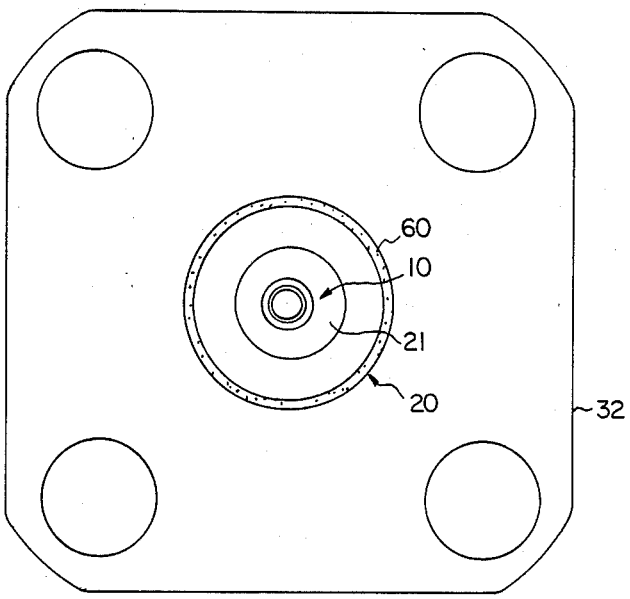
FIG. 2 is an end view of the assembly taken from the cable side thereof.
Figure 1:
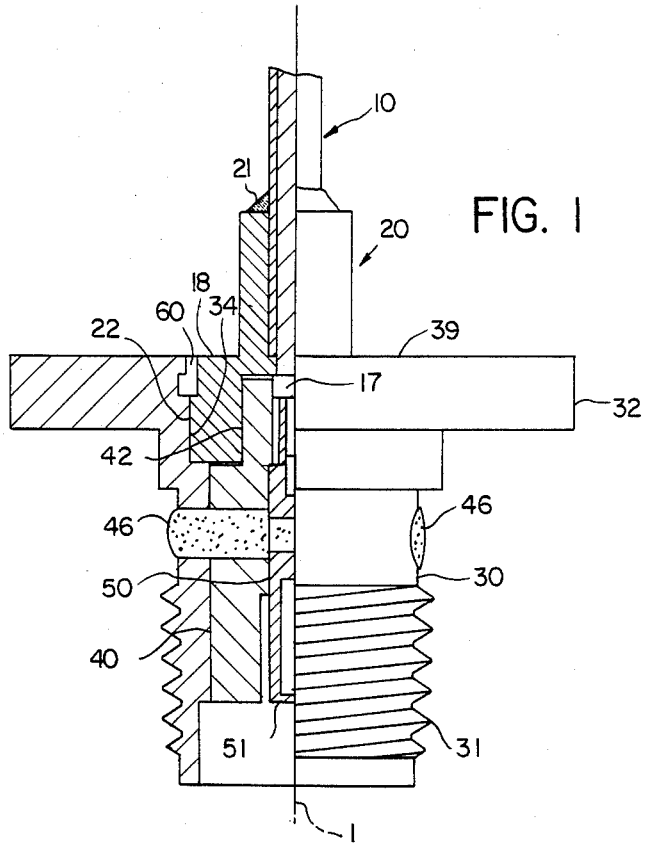
FIG. 1 is a partial longitudinal cross-section view of the coaxial cable-connector assembly for SHF signals incorporating features of the present invention.
Figure 3:
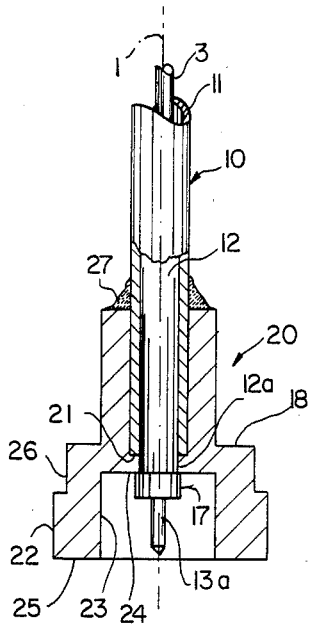
FIG. 3 is a longitudinal cross-section view of the end of the cable with the ferrule attached, ready for insertion into the connector.
Figure 4:
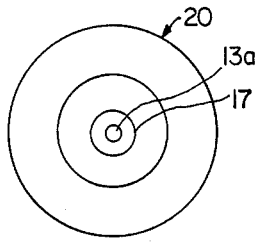
FIG. 4 is an end view of the cable with ferrule attached showing the end of the ferrule that encloses the projecting center conductor of the cable.
Figure 5:
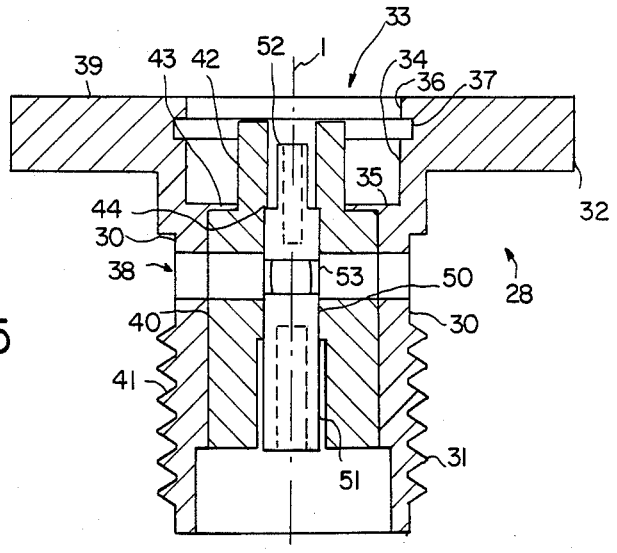
FIG. 5 is a longitudinal cross-section view of the connector before fixing the parts thereof in coaxial alignment with captivating epoxy so that the connector is ready to receive the cable ferrule.

FIGS. 3 and 4 show the end of the SHF cable with a coaxial ferrule attached thereto and ready for assembly with the connector. FIG. 5 shows the connector before the center connector dielectric and housing are fixed in position by captivating epoxy so that the connector is ready to receive the ferrule at the end of the cable. FIGS. 1 and 2 show the completed assembly.

Turning first to FIGS. 3 and 4, there is shown an end of the cable 10 which is, for example, Number 047, 50 ohm, SHF cable. The outer conductor 11 is copper about ten thousandths of an inch thick, the dielectric 12 is polytetra flouroethylene (PTFE) and the center conductor 13 is a beryllium copper wire about ten to fifteen thousandths of an inch in diameter and has a silver finish. This cable is prepared for attachment of the ferrule 20 by cutting back the outer conductor and dielectric as shown in FIG. 3, in two steps, exposing a short length of dielectric at 12*a* and a longer length of center conductor at 13*a*. The ferrule 20, a figure of revolution, slides over the prepared end of the cable until an internal shoulder of the ferrule at 21 abuts the cut end of the outer conductor of the cable. Then the ferrule is soldered at 27 to the outer conductor and so is a mechanical and an electrical extension of the outer conductor, increasing the diameter several times to the outside diameter surface 22 of the ferrule.

The inside wall 23 of the ferrule defines an annular space concentric with the extending end 13*a* of the cable center conductor. The wall 23 bottoms at a sharp inside corner meeting surface 24 that is flush with the cut end of the cable dielectric. The front end 25 of the ferrule is smooth and at right angle to the axis 1 of the cable and ferrule and forms sharp outside corners with the concentric surfaces 22 and 23.

A dielectric ring 17 slightly larger in outside diameter than the cable dielectric 12 fits snugly over the projecting end 13*a* of the cable center conductor and so projects into the inside annular space of the ferrule, short of the projecting cable center conductor. This end of the cable with ferrule attached is then ready for assembly with the connector 28.

Turning next to FIG. 5 is shown the connector 28 which is a flanged, threaded jack for receiving the conventional plug of a conventional 50 ohm coaxial cable. This connector includes a stainless steel housing 30 with ¼ inch diameter, 36 threads per inch thread at end 31 to accommodate a standard cable plug at that end and has a four hole flange 32 at the other end. An end view of the flange is shown in FIG. 2.

Within the connector housing 30 is inserted the connector dielectric body 40 and carried within this dielectric is the connector center conductor 50, both of which are essentially figures of revolution about the axis 1. The center conductor 50 has a spring finger at each end for engaging a center conductor. At the conventional end 31, the spring finger 51 receives the center conductor of the conventional cable plug and projects with clearance within a recess in the dielectric body 40.

At the other end of the center conductor 50 (at the connector flange end), is the spring finger 52 that receives the center conductor 13*a* of the cable. Finger 52 is enclosed with clearance by the concentric projection 42 of the dielectric from the shoulder 43 thereof. Both the finger 52 and the dielectric 42 projections project from the bottom into a concentric recess 33 in the face 39 of the flange 32 of the connector housing. This recess is defined in the housing by the smooth concentric inside wall 34 and receives the ferrule 20 so that the outside cylindrical surface 22 of the ferrule is a force fit against the inside wall 34 of the recess.

Thus, the wall 34 defines the cylindrical recess 33 at the flange face 39, into which the projecting dielectric 42 and spring finger 52 project and so the space between 34 and 42 is an annular space that receives the annular shaped ferrule defined by the inside and outside walls 23 and 22 of the ferrule. The bottom of that annular space in the connector that receives the ferrule is formed by a shoulder 35 from which the shoulder 43 of the dielectric 40 is set back slightly to ensure that the end 25 of the ferrule abuts the housing shoulder 35 and not the dielectric shoulder 43.

The entrance to the recess 33 at the connector flange at 36 is slightly widened and is undercut at 37 even wider to accommodate liquid epoxy that seals the cable-connector assembly after force fitting the cable ferrule into the connector recess. The ferrule 20 may include a cut back at 26 that is opposite 36 and 37 of the connector recess, which together define an annular undercut space to receive the sealing epoxy.

Before assembly, the connector housing 30 and dielectric 40 are drilled through by 0.04 inch diameter drill at 38 prior to installation of the connector center connector 50. This provides a transverse hole through the connector meeting a recessed portion 53 of the center conductor 50. The portion 53 may be knurled and slightly recessed as shown, so that it does not impede insertion of the center conductor as a tight fit within the dielectric body 40. The center conductor 50 is inserted into the dielectric 40 from the conventional connector end 31 of the connector up to a slight shoulder at 44 on the inside of the dielectric.

The purpose of the drill hole at 38 and the recessed knurled portion 53 of the center conductor 50 is to receive captivating epoxy when the center conductor 50 is aligned properly coaxially and axially within the connector housing, and thereby fix the center conductor in that position so that it will be aligned properly on the axis 1 and, in particular, the finger 52 that engages the cable center conductor will be aligned concentric with the recess 33 that receives the cable ferrule and so the finger 52 will be aligned properly to receive the center conductor of the cable. Likewise, at the other end, the finger 51 will be aligned properly on the axis to receive the center conductor of the conventional coaxial cable plug that is connected thereto. For this purpose, the portion 53 of the center conductor is slightly set back from the rest of the center conductor to insure a flow of captivating epoxy around it and it is knurled to enhance the grip of the epoxy thereto.

The connector housing 30, as mentioned above, is stainless steel and may be plated gold on nickel, particularly on the inside which bounds the electric fields of electric wave signals conducted. The connector dielectric body 40 is preferably teflon and fits tightly within the housing. The center conductor 50 is gold plated copper.

The assembly of the cable with the connector is shown in FIGS. 1 and 2. Before assembly, the connector housing, dielectric and center conductor are fixed in position by injecting the captivating epoxy 46 into the hole 38 so that it flows completely through the hole and around the center portion 53 of the center conductor. This is done while the housing and center conductor are held aligned in, for example, a suitable tool. When the epoxy 46 has set, the connector is ready for assembly with the cable. That assembly is accomplished by inserting the ferrule 20 at the end of the cable into the annular recess 33 at the flange end of the connector defined by cylindrical wall 34 and the projecting dielectric 42. At this assembly, the ferrule is forced into the annular space of the recess and so the outer surface 22 of the ferrule and the surface 34 of the recess in the connector make intimate forced contact. The ferrule is pushed into the recess until the ferrule end 25 bottoms on connector housing shoulder 35. In this engagement, the projecting dielectric 42 fills the inside of the ferrule, fitting snugly around the dielectric ring 17, and the extending center conductor 13*a* of the cable fits inside the spring finger 52 making intimate mechanical and electrical contact therewith. When properly inserted, the shoulder 18 of the ferrule is flush with the face 39 of the connector flange, or the ferrule shoulder is slightly recessed below the flange face within the recess 33.

When the ferrule is inserted into the connector, as described above, there is assurance that the projecting center conductor 13*a* of the cable will align perfectly with the spring finger 52 and while the force fit is being accomplished, the alignment will be maintained, because the captivating epoxy 46 bonds the connector center conductor, dielectric and housing together. When the ferrule is seated as described within the connector recess 33, the cut back portions 36 and 37 at the entrance to recess 33 of the connector and 26 of the ferrule define an undercut annular space to receive the sealing epoxy 60 that seals the electrical connections between the cable and connector within the connector, and also fixes the ferrule to the connector and resists forces that would tend to pull the ferrule from the connector. Such forces would have to shear the undercut portion of the epoxy seal 60 in order to pull the ferrule from the connector.

A cable-connector assembly constructed and fabricated as described herein can withstand a pull force on the ferrule of twenty five pounds or more, while the center conductor connection can withstand a pull of ten pounds or more. In the super high frequency operating range of 18 to 22 GHz, the maximum VSWR of such a cable-connector assembly is not more than 1.37:1.

Figure 6:
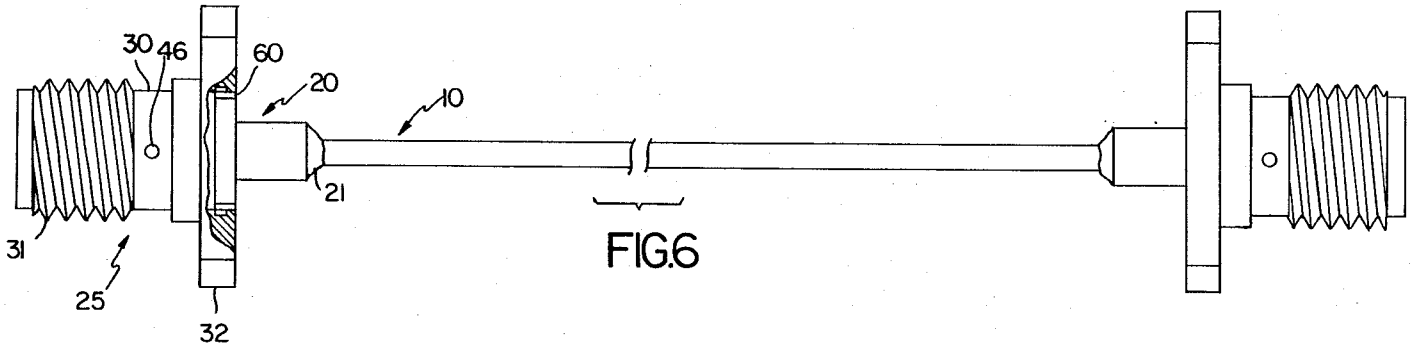
FIG. 6 is a longitudinal view of an assemble of a length of the cable with a connector at each end thereof; and FIGS. *7a, b* and *c* show the steps of cutting the cable and preparing the cut end for attachment to a low impedance circuit element such as a YIG filter.
Figure 7A:
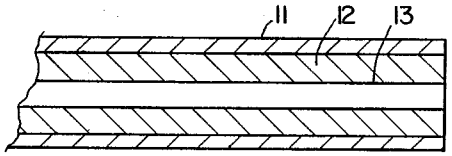
Figure 7B:
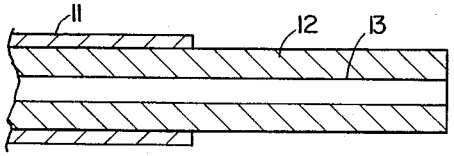
Figure 7C:
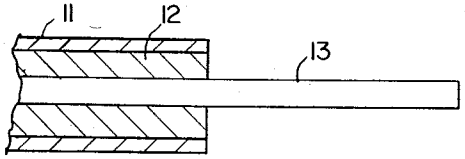

A cable such as cable 10 with a ferrule such as 20 at each end, attached to a connector such as 25 at each end, is shown in FIG. 6. This assembly provides the user two cable-connector assemblies. For example, the user may cut the cable at just about any place between the two connectors and then prepare the cut end of the cable as shown in FIGS. *7a, b* and *c* for attachment to a low impedance SHF circuit element to provide a coaxial port for the element. Thus, the assembly shown in FIG. 6 provides the user the parts for two SHF ports. FIG. *7a* shows the cut end of the cable which is preferably a clean transverse cut. FIG. *7b* shown a length of the outer conductor 11 cut back to expose the dielectric and FIG. *7c* shows the dielectric cutback to expose the center conductor. The end prepared as shown in FIG. *7c* is then ready for connection to the high frequency circuit element to provide a coaxial connector port to that element.

Other configurations of the cable-connector assembly of the present invention may occur to those skilled in the art within the spirit and scope of the invention and so the invention is not to be construed as limited in it's scope except as set forth in the appended claims.

What is claimed is:

1. An SHF coaxial cable-connector assembly for connection to a relatively low impedance SHG circuit element to provide said element with a coaxial connector port for conducting SHF signals to or from said circuit element comprising, (a) a coaxial cable having an outer conductor, dielectric and center conductor of SHF impedance on the same order as said element, (b) an electrically conductive ferrule attached to an end of said cable to said outer conductor thereof defining a cable annular space beyond the end of said cable outer conductor and dielectric into which the end of said cable center conductor extends, (c) a coaxial connector having an outer conductor housing, dielectric and center conductor of impedance on the same order as said cable impedance and (d) a connector recess at one end of said connector outer conductor housing into which an end of said connector center conductor projects and (e) said connector dielectric projects into said connector recess and is adapted to fit into said cable annular space, (f) the dimensions of said ferrule and said connector recess being such that said ferrule is a force-fit into said recess and (g) said projecting connector center conductor and said extending cable center conductor being so constructed that they are mechanically and electrically connected, (h) whereby cable is mechanically connected to said connector and said cable inner and outer conductors are mechanically and electrically connect to said connector inner and outer conductors, respectively.

2. An assembly as in claim 1 wherein, (a) a coaxial annular space is provided at the entrance of said connector recess into which said ferrule is force-fit to said connector and (b) a sealing epoxy in said annular space, (c) whereby electrical connections between said cable and said connector are sealed within said connector by said epoxy.

3. An assembly as in claim 1 wherein, (a) said connector center conductor projection is a spring finger that projects into said connector recess and is adapted to receive said extending cable center conductor as said ferrule is forced into said recess.

4. An assembly as in claim 1 wherein, (a) said connector recess includes a shoulder on the inside of said connector housing, (b) a corresponding shoulder is provided on said connector dielectric, (c) said housing and dielectric shoulders form the bottom of said connector recess, one being displaced axially with respect to the other so that said ferrule inserted into said connector recess abuts the housing shoulder and clears the dielectric shoulder, (d) whereby the forced insertion of said ferrule into said recess does not bear axially against said connector dielectric.

5. An assembly as in claim 1 wherein, (a) a space is provided within said connector through said connector housing and dielectric and around said connector center conductor and (b) said space is filled with a captivating epoxy dielectric, (c) whereby said connector center conductor is fixed in position with respect to said connector housing and recess.

6. An assembly as in claim 1 wherein, (a) opposing recesses are provided on said ferrule and at the entrance to said connector recess, (b) said opposing recesses define an annular space accessible to the outside of said connector for receiving a sealing epoxy dielectric and (c) a sealing epoxy dielectric in said annular space that seals electrical connections between said cable and connector within said connector.

7. An assembly as in claim 1 wherein, (a) said connector center conductor projection is a spring finger that projects into said connector recess and is adapted to receive said projecting cable center conductor as said ferrule is forced into said recess, (b) said connector recess includes a shoulder on the inside of said connector housing and (c) a corresponding shoulder is provided on said connector dielectric, (d) whereby the forced insertion of said ferrule into said recess does not bear axially against said connector dielectric.

8. An assembly as in claim 7 wherein, (a) opposing recesses are provided on said ferrule and at the entrance to said connector recess, (b) said opposing recesses define an annular space accessible to the outside of said connector for receiving a sealing epoxy dielectric and (c) a sealing epoxy dielectric in said annular space that seals electrical connections between said cable and connector within said connector.

* * * * *